US008128864B2

(12) United States Patent
Engler et al.

(10) Patent No.: US 8,128,864 B2
(45) Date of Patent: Mar. 6, 2012

(54) SIZE FOR PRODUCTION OF A BN-CONTAINING COATING, METHOD FOR PRODUCTION THEREOF, COATED BODY PRODUCTION AND USE THEREOF

(75) Inventors: Martin Engler, Kempten (DE); Krishna Uibel, Kempten (DE)

(73) Assignee: ESK Ceramics GmbH & Co. KG, Kempten (DE)

( * ) Notice: Subject to any disclaimer, the term of this patent is extended or adjusted under 35 U.S.C. 154(b) by 402 days.

(21) Appl. No.: 12/310,496

(22) PCT Filed: Aug. 13, 2007

(86) PCT No.: PCT/EP2007/007153

§ 371 (c)(1), (2), (4) Date: Apr. 24, 2009

(87) PCT Pub. No.: WO2008/025448

PCT Pub. Date: Mar. 6, 2008

(65) Prior Publication Data

US 2009/0236780 A1 Sep. 24, 2009

(30) Foreign Application Priority Data

Sep. 1, 2006 (DE) ..... 10 2006 041 047

(51) Int. Cl.
*C21B 5/44* (2006.01)

(52) U.S. Cl. ..... 266/280; 266/270

(58) Field of Classification Search ..... 266/200, 266/280; 106/270, 243
See application file for complete search history.

(56) References Cited

U.S. PATENT DOCUMENTS

2006/0163533 A1* 7/2006 Batz-Sohn et al. ..... 252/182.32
2007/0054057 A1* 3/2007 Matje et al. ..... 427/421.1

FOREIGN PATENT DOCUMENTS

DE 103 26 769 B3 11/2004

OTHER PUBLICATIONS

Schwetz, et al. "Boron Carbide, Boron Nitride, and Metal Borides", *Ullmann's encyclopedia of industrial chemistry*, 1985, vol. A, 4th Edition, pp. 295-297, Weinheim: VCH Verlagsgesellschaft.

* cited by examiner

*Primary Examiner* — Scott Kastler
(74) *Attorney, Agent, or Firm* — The Nath Law Group; Tanya E. Harkins

(57) ABSTRACT

The invention relates to a water-containing slip for producing a BN-containing coating on a substrate, which comprises, based on the solids content of the slip, a) 45-90% by weight of BN, b) 3-25% by weight of boehmite nanoparticles, c) 0.5-5% by weight of at least one borate, d) 2-30% by weight of at least one water-insoluble boron compound which is different from the components a) and c), e) 2-30% by weight of an organic compound, where the solids content of the slip is 15-60% by weight.

27 Claims, 1 Drawing Sheet

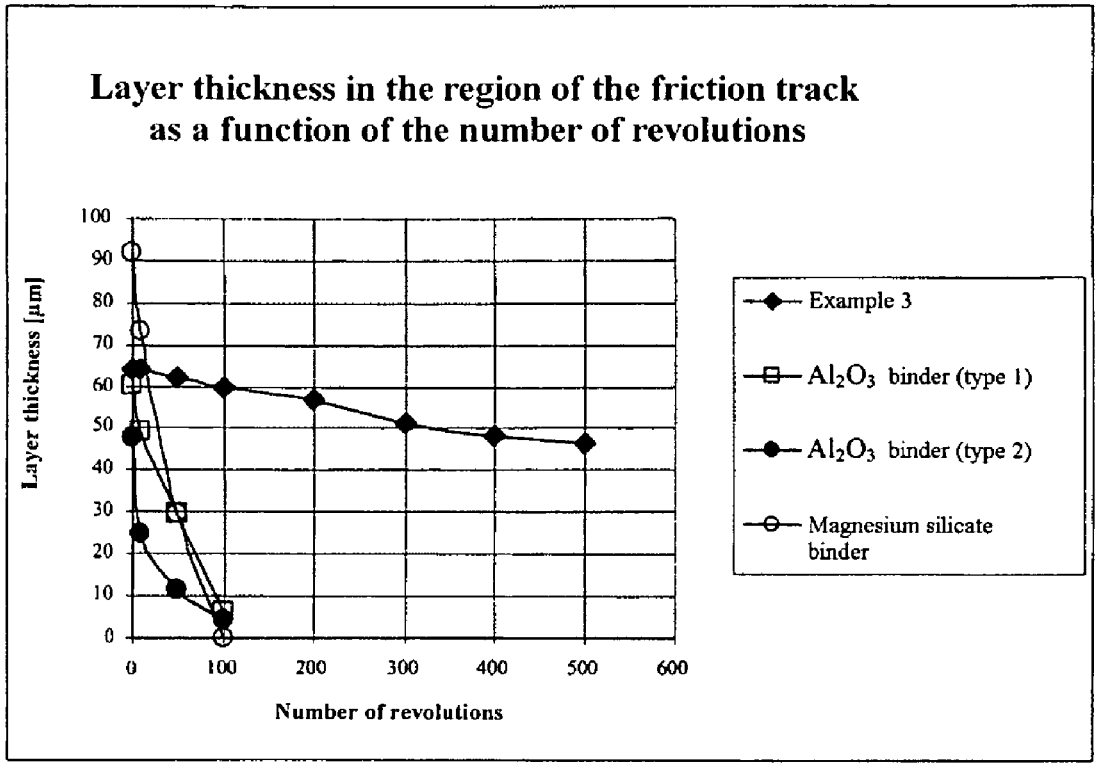
Layer thickness in the region of the friction track as a function of the number of revolutions
Layer thickness [µm]
100
90
80
70
60
50
40
30
20
10
0
0
100
200
300
400
500
600
Number of revolutions
Example 3
Al2O3 binder (type 1)
Al2O3 binder (type 2)
Magnesium silicate binder

SIZE FOR PRODUCTION OF A BN-CONTAINING COATING, METHOD FOR PRODUCTION THEREOF, COATED BODY PRODUCTION AND USE THEREOF

This application was filed under 35 U.S.C. 371 as a national stage of PCT/EP2007/007153, with the filing date of 13 Aug. 2007, the entire content of which is hereby incorporated by reference in its entirety.

FIELD OF THE INVENTION

The present invention relates to a water-containing size (hereinafter also called "slip" or "wash") for producing a BN-containing coating on a substrate, a process for producing such a slip, a coated body comprising a substrate and a coating which has been produced from the slip applied to the substrate and also the use of the coated body, for example in the form of mold frames, pouring spouts and containers for keeping materials hot, in the field of foundry applications, in particular light metal foundry applications.

PRIOR ART

The working equipment and apparatuses used in foundries, e.g. mold frames, pouring spouts and containers for keeping metal melts hot and transporting metal melts, are generally provided with a coating in order to protect this equipment and these apparatuses against the highly corrosive metal melts, e.g. aluminum melts, at temperatures in the range from 600 to 950° C. Such coatings are usually produced using slips based on BN slurries in water, if appropriate with inorganic or organic binders. Binders used are, for example, aluminum oxide, bentonite, phosphates and silicates. However, these slips have the disadvantage that only powdery layers or layers having a low thickness can be applied without cracks occurring and that the coatings tend to flake off and therefore have only a limited life. A further disadvantage is that coatings produced from these slips are not abrasion-resistant or have only limited abrasion resistance in the cold state, so that damage to the coatings can easily occur, for example during cleaning by means of metallic articles such as tongs and iron rods. If the coating is not abrasion- and scratch-resistant, it is easily destroyed during such procedures.

On the other hand, BN-containing hard coatings and mold release layers are likewise known from the prior art. Thus, DE 101 27 494 B4 describes an inorganic layer which is stable at high temperatures and is produced from a ceramic mix of boron nitride, at least one inorganic binder system comprising ceramic nanoparticles and at least one solvent, for example water.

EP 1 386 983 B1 describes a ceramic coating produced from a mixture of boron nitride, at least one inorganic binder having an average particle size in the nanometer range and at least one solvent and/or water by applying the mixture to a metallic or ceramic surface and baking the mixture.

DE 103 26 769 B3 describes durable BN mold release layers for the pressure casting of nonferrous metals and slips for producing them, with refractory nanosize binders being used as binder phase for boron nitride. In particular, suspensions of $SiO_2$-based sol-gel binders and BN powders are applied to metal surfaces or inorganic nonmetallic surfaces and the coatings obtained in this way are dried and thermally densified. At temperatures above 500° C., the binder system is converted into a vitreous matrix which gives the resulting ceramic layer mechanical stability.

However, the abovementioned BN hard coatings and mold release layers cannot be used for metal foundry applications since these layers require careful pretreatment of the surface and a high uniformity in application of the layer, which cannot be implemented under the conditions in foundries. Likewise, uneven substrates also have to be coated in foundries, which is likewise not possible using the slips known from the abovementioned patent texts. Like the foundry slips customarily used at present in foundries, the slips described in these patent texts allow only layers having a limited thickness to be applied, dried and baked without occurrence of defects. Furthermore, these layers have only a limited life and have only limited abrasion and scratch resistance in the cold state.

OBJECT OF THE INVENTION

It is therefore an object of the invention to provide a BN-containing slips by means of which thick coatings having a long life and no cracks can be produced, with the coatings not tending to flake and having a susceptibility to cracking, in particular when used in foundry applications, which is lower than in the case of the coatings known from the prior art for foundry applications and having an abrasion resistance in the cold state which is higher than that of the known coatings for foundry applications.

SUMMARY OF THE INVENTION

The abovementioned object is achieved, according to the invention, by a slip for producing a BN-containing coating on a substrate as claimed in claim 1, a process for producing such a slip as claimed in claim 20, a coated body comprising a substrate having a coating applied thereto as claimed in claim 21, a process for producing such a coated body as claimed in claim 25 and the use of a coated body as claimed in claim 29. Advantageous or particularly useful embodiments of the subject matter of the application are defined in the dependent claims.

According to the invention, it has surprisingly been found that the coatings produced from the slips of the invention are flexible over a prolonged time at customary use temperatures, a property which will hereinafter be referred to as "hot flexibility". Such hot flexibility cannot be observed for the coatings known from the prior art. As a result of this property, the formation of cracks in the coatings as a result of different coefficients of expansion between substrate and coating material can be prevented or any cracks which occur can be healed again so that the coatings according to the invention have a self-healing property. As a result, the coatings produced according to the invention also have a significantly reduced tendency to undergo flaking during use, so that coatings having a significantly longer life are achieved.

This flexibility over the entire use temperature range makes it possible for the coatings to be heated rapidly from room temperature to the customary use temperatures of from 600 to 950° C.

Furthermore, the coatings produced according to the invention are abrasion-resistant even in the cold state, which is not the case for layers produced from conventional foundry slips. This reduces the risk of damage to the coatings during cleaning by means of tools and the equipment and apparatuses provided with such a coating can be reused without repair for a longer time.

It is also possible to produce thick layers without cracks using the slips of the invention, with the possible layer thickness being significantly higher than in the case of the coatings known from the prior art. The production of thick layers also makes it possible to fill and close any cracks and surface irregularities in the substrate. Furthermore, defects in the equipment and tools can be filled by the high layer thicknesses which can be achieved, without cracks being formed during subsequent drying. In addition, any cracks formed can be sealed by the slips of the invention. A further advantage of such thick layers is their longer life, since a higher layer thickness is available for wear, including abrasive wear.

In addition, the slips of the invention can also be applied to dirty substrates without complicated surface pretreatment, which is not possible when using slips according to the patent texts mentioned at the outset.

An additional surprising advantage of the coatings which can be produced according to the invention is that substrates which are not resistant to oxidation, for example metal or graphite, can be effectively protected against corrosion by decomposition of the water-insoluble boron compound present in the coatings at temperatures from 600° C. upward. Such decomposition of the water-insoluble boron compound obviously proceeds with consumption of oxygen, so that oxygen cannot get to the substrate surface during the decomposition of the boron-containing compound in the coating.

BRIEF DESCRIPTION OF THE ACCOMPANYING DRAWING

FIG. 1 is a graph from an abrasion test in which the abrasion resistance of a coating produced from a slip according to the invention as per example 3 was compared with commercial coatings.

DETAILED DESCRIPTION OF THE INVENTION

The invention accordingly provides a water-containing slip for producing a BN-containing coating on a substrate, which comprises, based on the solids content of the slip, a) 45-90% by weight of BN,
b) 3-25% by weight of boehmite nanoparticles,
c) 0.5-5% by weight of at least one borate,
d) 2-30% by weight of at least one water-insoluble boron compound which is different from the components a) and c),
e) 2-30% by weight of an organic compound, where the solids content of the slip is 15-60% by weight.

As solvent or dispersion medium for the water-containing slips of the invention, it is possible to use water, alcohols, such as ethanol or water/alcohol mixtures. For use as foundry slip, preference is given to using only water since flammable solvents are undesirable for such applications.

The solids content of the slip is preferably 20-40% by weight, more preferably 25-35% by weight.

Based on the solids content of the slip, the BN content is preferably 45-85% by weight, more preferably 45-75% by weight, the content of boehmite nanoparticles is preferably 5-20% by weight, more preferably 10-18% by weight, the content of borate is preferably 1-4% by weight, more preferably 1-3% by weight, the content of the water-insoluble boron compound is preferably 5-25% by weight, more preferably 5-20% by weight, and the content of an organic compound is preferably 3-20% by weight, more preferably 3-15% by weight.

Furthermore, preference is given to the slip of the invention comprising, based on the total composition of the slip, at least one of the following components f) up to 2% by weight, preferably up to 1% by weight, more preferably up to 0.5% by weight, of boric acid,
g) up to 15% by weight, preferably 0.5-10% by weight, particularly preferably 1-8% by weight, of at least one hard material selected from among oxides, carbides and nitrides,
h) up to 15% by weight, preferably 0.5-10% by weight, more preferably 1-8% by weight, of at least one metal powder.

The BN of component a) is preferably used as BN powder having an average particle size of 1-30 μm, more preferably 2-15 μm. It is also possible to use BN agglomerates having an average agglomerate size of 20-100 μm, preferably 20-50 μm. Mixtures of the two forms are likewise possible. The BN used can additionally contain up to 10% by weight of various impurities and additives. Particular mention may be made of boric acid, boron trioxide, carbon, alkali metal borates or alkaline earth metal borates. However, preference is given to using very pure, washed BN having a purity of at least 98%, preferably 99%.

The boehmite nanoparticles used in the slip of the invention preferably have an average particle size of 1-100 nm, more preferably 1-40 nm and particularly preferably 2-20 nm. It is possible to use commercially available boehmite powder, for example as marketed by Sasol as the Disperal or Dispal grades, with preference being given to using a boehmite powder having the trade name Disperal P2.

The borate c) is preferably selected from the group consisting of lithium borate, potassium borate, sodium borate, calcium borate and borax, with borax being particularly preferred. The borate can also be present as a production-related impurity in the BN powder.

The water-insoluble boron compound d) is preferably selected from the group consisting of boron carbide ($B_4C$), metal borides and elemental boron. These boron compounds are oxidized to boron oxide by atmospheric oxygen during the intended use of the slips, with boron carbide being particularly preferred. Examples of suitable metal borides are $TiB_2$, $ZrB_2$ and $CaB_6$.

Suitable organic compounds e) are compounds which during the intended use of the slips form a liquid or viscous phase and burn out at elevated temperatures to leave pores. Such organic compounds are preferably selected from the group consisting of synthetic polymers such as thermoplastics, natural polymers such as celluloses and cellulose derivatives, waxes, oils and polyphosphate esters. It is likewise possible to use water-based surface coatings in the form of a suspension or emulsion having a fine distribution of disperse phase, preferably having a particle or droplet size of <50 μm. Preference is given to low-melting compounds and water-insoluble compounds. Water-soluble compounds should not crystallize out. Particular preference is given to using a polyvinyl butyral (PVB) as organic compound.

The hard materials g) which are present if desired are preferably selected from the group consisting of $Al_2O_3$, $ZrO_2$, $TiO_2$ and SiC. These additional hard materials increase the abrasion resistance in the cold state of the coatings produced from the slips. Although $TiO_2$ has the lowest hardness among the materials just mentioned, it is particularly suitable when the wash is used under oxidizing conditions.

The metal powder h) which is present if desired is then preferably added when the slips of the invention are intended for coating metallic substrates. The metal powders are preferably selected from the group of the metals Al, Mg, Si, Zr, Sn, Zn, mixtures or alloys thereof which are able to dissolve iron from metallic substrates. As a result, mixed crystals or intermetallic phases are formed at the interface between substrate and coating. The oxidation products of these phases form a protective film, resulting in the oxidation resistance of the substrate being considerably improved thereby. The metal powder h) is particularly preferably selected from the group of light metals having a melting point below 800° C., particularly preferably from among Al, Mg, their mixtures and alloys.

The invention likewise provides a process for producing a water-containing slip according to the invention, which comprises the steps i) production of a boehmite sol in an aqueous medium, ii) addition of the remaining constituents with simultaneous homogenization to produce the slip.

To produce the boehmite sol, it is possible to use commercially available boehmite powder grades having particle sizes in the nanometer range, for example the abovementioned, commercially available boehmite powders from Sasol. The boehmite powders are stirred into an aqueous medium, preferably water, which has more preferably been preheated, preferably to temperatures above 80° C. As an alternative, a boehmite sol can be produced by alkoxide routes as per the Yoldas process or by use of aluminum salts and addition of a base. After homogenization, the dispersion is usually peptized and converted into a sol by addition of acid. It is advantageous to set solids concentrations in the sol of up to 20% by weight of boehmite, preferably 5-12% by weight.

The boehmite sol produced as described above serves as dispersion medium into which the remaining constituents of the slip are introduced by addition of the powder components in portions with simultaneous homogenization. Homogenization can be effected by means of customary stirring apparatuses, e.g. a blade stirrer. The remaining components are preferably added in the order: 1) water-soluble constituents, 2) fine powders and 3) coarse powders. To achieve high degrees of dispersion, homogenization can be carried out in a ball mill, in an attritor, by means of an Ultraturrax or by means of other dispersing or milling apparatuses.

The invention further provides a coated body comprising a substrate having a coating applied thereto, wherein the coating has been produced from a slip according to the invention.

The substrate can be a metallic, ceramic or other inorganic (e.g. graphite) substrate. The substrate can be present in the form of any shaped part or shaped body, a film, a woven fabric or a fiber.

The coating provided according to the invention preferably has a thickness of 5-2000 μm, more preferably 15-1000 μm, particularly preferably 30-500 μm, with these layer thicknesses being average layer thicknesses in each case. It has hitherto not been possible in the prior art to achieve defect-free coatings of this thickness, in particular on metallic or dense substrates. Rather, the defect-free applied layer thicknesses according to the prior art are usually 20-150 μm.

The invention likewise provides a process for producing a body which has been coated as described above, which comprises the steps 1) application of the above-described slip according to the invention to the substrate by one or more doctor blade coating, dipping, flooding, spin coating, spraying, brushing or painting steps, 2) drying of the coating obtained in this way, 3) baking of the coating.

In step 1) above, application of the slip can be carried out at room temperature or at substrate temperatures of up to 300° C. If appropriate, the substrate can be pretreated with a primer.

Drying of the still moist coating can be carried out at room temperature, but preferably at temperatures of 80-100° C.

Baking in step 3) can be effected in situ during use of the coated body in a foundry application, with introduction of heat occurring either by contact with metal melts or hot shaped parts or by radiation and/or convection. However, baking can alternatively be carried out beforehand in a separate process step at temperatures of from 180 to 800° C., preferably at temperatures of 470° C. or above, in particular 500° C. or above.

Without wishing to be tied to a particular theory, the function and mode of action of the individual components of the slip of the invention in the formation of coatings can be explained as follows. As mentioned above, the coatings which can be achieved according to the invention are hot-flexible and self-healing. This can be explained by a liquid or viscous phase which ensures that no cracks are formed or that any cracks formed are closed again always being available in the slip or the coating when going through the entire temperature range from room temperature to the use temperature of about 750° C. The various components of the slip produce overlapping ranges of liquid or viscous phases: water to 100° C., then liquefaction of the organic compound, for example liquid PVB at about 70-200° C., boric acid, if present, from 170° C. and boron oxide from 450° C. and finally, above 600° C., the water-insoluble boron compound such as $B_4C$ is oxidized to $B_2O_3$. Dissolved borax ($Na_2B_4O_7 \times 10H_2O$) melts at about 75° C. and decomposes as the temperature is increased further into anhydrous borax which in turn melts at about 742° C.

According to the invention, it has likewise been found that when the abovementioned water-insoluble boron compound d), in particular $B_4C$, is replaced by a corresponding proportion of $B_2O_3$ or of boric acid, the $B_2O_3$ in the coating crystallizes out and flaking of the coating occurs. However, if the water-insoluble boron compound, in particular $B_4C$, is added as per the invention, $B_2O_3$ is obviously likewise formed as oxidation product but, surprisingly, the undesirable effect of crystallization and flaking of the layer does not occur. This would not have been able to be foreseen by a person skilled in the art.

Owing to the above-described advantages and properties, a body which has been coated according to the invention is particularly useful in the field of foundry applications, in particular light metal foundry applications. For example, the coated body is in this case a mold frame, a pouring spout or a container for keeping metal melts hot or transporting metal melts.

The slips of the invention can also be used in an inverse coating process. Here, a coating is applied to a sand mold using a slip according to the invention. A metal, preferably a metal having a melting point of >1200° C., is then poured into the mold which has been coated in this way and the sand mold is subsequently removed. Such a process makes it possible to obtain a metallic article, for example a casting ladle, which has already been provided with a coating according to the invention which has been baked in situ.

The following examples illustrate the invention.

Example 1

Production of a Boehmite Sol Via the Powder Route 400 ml of water are heated to 85-95° C. 34 g of nanosize boehmite powder are added while stirring vigorously. Homogenization is carried out by vigorous stirring for 10 minutes. The suspension is peptized by means of 6 ml of concentrated nitric acid at the process temperature. An aging step is not carried out. The sol becomes more concentrated during the synthesis. The sol is diluted to a boehmite solids content of 7.1% by weight by addition of water.

Example 2

Production of a Boehmite Sol Via the Precursor Route (Alkoxides)

500 ml of water having a temperature of 85-100° C. are placed in a vessel. The pH of the water is set to a value of below 1 by means of nitric acid before the synthesis. 98 g of aluminum isopropoxide are subsequently added. The volume of the sol is reduced rapidly to ⅗ at the boiling point of the sol. In the second acid addition, the sol is peptized by means of 10 ml of concentrated nitric acid, followed by rapid cooling of the sol. The sol is diluted to a boehmite solids content of 7.1% by weight by addition of water. An aging step is not carried out.

Example 3

Production of a Slip 108.3 g of sol from example 1 or example 2 having a solids content of boehmite of 7.1% by weight (corresponding to a content of 8.3 g of hydrated boehmite powder Disperal P2 or corresponding to 6 g of resulting $Al_2O_3$ content) is placed in a vessel as dispersion medium. The pulverulent components of the suspension are homogenized in the sol using an Ultraturrax. 1 g of boric acid, 1 g of borax, 4 g of boron carbide having an average particle size of 1 μm, 30 g of boron nitride having an average particle size of 4 μm and 3.3 g of polyvinyl butyral are added separately in portions while the dispersing apparatus is running.

Example 4

Production of a Slip 108.3 g of sol from example 1 or example 2 having a solids content of boehmite of 7.1% by weight (corresponding to a content of 8.3 g of hydrated boehmite powder Disperal P2 or corresponding to 6 g of resulting $Al_2O_3$ content) is placed in a vessel as dispersion medium. The pulverulent components of the suspension are homogenized in the sol using an Ultraturrax. 1 g of borax, 2 g of boron carbide having an average particle size of 1 μm, 2 g of titanium diboride having an average particle size of 4.5 μm, 30 g of boron nitride having an average particle size of 4 μm, 1 g of aluminum oxide and 2 g of polyvinyl butyral are added separately in portions while the dispersing apparatus is running.

Example 5

Production of a Slip 108.3 g of sol from example 1 or example 2 having a solids content of boehmite of 7.1% by weight (corresponding to a content of 8.3 g of hydrated boehmite powder Disperal P2 or corresponding to 6 g of resulting $Al_2O_3$ content) is placed in a vessel as dispersion medium. The pulverulent components of the suspension are homogenized in the sol using an Ultraturrax. 0.5 g of borax, 1 g of boron carbide having an average particle size of 1 μm, 30 g of boron nitride having an average particle size of 4 μm and 1 g of polyvinyl butyral are added separately in portions while the dispersing apparatus is running. 2 g of aluminum powder (standard Al powder PCS, Eckert-Werke) are subsequently stirred in using a blade stirrer.

Comparative Examples

1. Abrasion Test (Taber Abraser Tests) on a Coating According to the Invention and Comparative Coatings For comparative tests on the abrasion resistance of the coatings, flat ground discs of hot-working steel 1.2343 (X38CrMoV5-1) were used as substrate. The BN suspensions (slips according to the invention as per example 3, commercial slips containing aluminum oxide binder, type 1 and type 2, and also slips containing magnesium silicate binder) were applied by spraying, dried at 90° C. for half an hour and baked at 750° C. for half an hour.

After baking, the coated plates were cooled to room temperature and tested in a Taber Abraser test, 3N, friction rollers AT20D1-CS110F.

The tests were carried out using an instrument from

TABER® INDUSTRIES

455 Bryant Street

North Tonawanda, N.Y. 14120

USA.

The friction rollers AT20D1—CS-110F were cleaned before each test. The result of the tests is shown in FIG. 1. The BN slip having the lowest removal of material in the test is the slip according to the invention from example 3. In the case of the comparative slips, virtually the entire original 50-90 μm thick coating has been removed after only 100 revolutions, while in the case of the slip according to the invention from example 3, the coating is removed only very slowly and a coating having a thickness of over 40 μm remains even after 500 revolutions.

2. Cross-Cut Test on a Coating According to the Invention and Comparative Coatings For a comparative examination of the adhesion of the coatings, cross-cut tests in accordance with DIN EN ISO 2409 were carried out on flat-ground coated discs of hot-working steel (1.2343 X38CrMoV5-1). The application and also drying and baking of the coatings were carried out as described under 1.

The result of the tests is shown in table 1.

TABLE 1

Results of the cross-cut test for various BN coatings

| | Coating according to the invention (example 3) | $Al_2O_3$ binder (type 1) | $Al_2O_3$ binder (type 2) | Magnesium silicate binder |
|---|---|---|---|---|
| GT value | 0 | 1 | 5 | 5 |

According to DIN EN ISO 2409, a GT value of 0 corresponds to the best adhesion which can be determined. The coating according to the invention as per example 3 has achieved the best value. Table 2 summarizes the GT values which can be determined.

TABLE 2

| Assignment of GT values | |
|---|---|
| GT values | Description (summary) |
| 0 | no flaking |
| 1 | about 5% flaking |
| 2 | about 15% flaking |
| 3 | about 35% flaking |
| 4 | about 65% flaking |
| 5 | >65% flaking |

The invention claimed is:

1. A water-containing slip for producing a BN-containing coating on a substrate, which comprises, based on the solids content of the slip, a) 45-90% by weight of BN, b) 3-25% by weight of boehmite nanoparticles, c) 0.5-5% by weight of at least one borate, d) 2-30% by weight of at least one water-insoluble boron compound which is different from the components a) and c), e) 2-30% by weight of an organic compound, where the solids content of the slip is 15-60% by weight.

2. The slip as claimed in claim 1, wherein the BN of component a) is present in a proportion of 45-85% by weight.

3. The slip as claimed in claim 1, wherein the boehmite nanoparticles b) are present in a proportion of 5-20% by weight.

4. The slip as claimed in claim 1, wherein the borate c) is present in a proportion of 1-4% by weight.

5. The slip as claimed in claim 1, wherein the water-insoluble boron compound d) is present in a proportion of 5-25% by weight.

6. The slip as claimed in claim 1, wherein the organic compound e) is present in a proportion of 3-20% by weight.

7. The slip as claimed in claim 1, wherein the solids content of the slip is 20-40% by weight.

8. The slip as claimed in claim 1, which further comprises, based on the total composition of the slip, at least one of the following components f) up to 2% by weight of boric acid, g) up to 15% by weight of at least one hard material selected from among oxides, carbides and nitrides, h) up to 15% by weight of at least one metal powder.

9. The slip as claimed in claim 1, wherein the borate c) is selected from the group consisting of lithium borate, potassium borate, sodium borate, calcium borate and borax.

10. The slip as claimed in claim 1, wherein the water-insoluble boron compound d) is selected from the group consisting of boron carbide, metal borides and elemental boron.

11. The slip as claimed in claim 1, wherein the organic compound e) is selected from the group consisting of synthetic polymers, natural polymers, waxes, oils and phosphate esters.

12. The slip as claimed in claim 1, wherein the organic compound e) is a polyvinyl butyral.

13. The slip as claimed in claim 1, wherein the BN of component a) is a BN powder having an average particle size of 1-30 μm.

14. The slip as claimed in claim 1, wherein the boehmite nanoparticles b) have an average particle size of 1-100 nm.

15. The slip as claimed in claim 8, wherein the boric acid f) is present in a proportion of up to 1% by weight, based on the total composition of the slip.

16. The slip as claimed in claim 8, wherein the hard materials g) are present in a proportion of 0.5-10% by weight, based on the total composition of the slip.

17. The slip as claimed in claim 8, wherein the hard materials g) are selected from the group consisting of $Al_2O_3$, $ZrO_2$, $TiO_2$ and SiC.

18. The slip as claimed in claim 8, wherein the metal powder h) is present in a proportion of 0.5-10% by weight, based on the total composition of the slip.

19. The slip as claimed in claim 8, wherein the metal powder h) is selected from the group of the metals Al, Mg, Si, Zr, Sn, Zn, their mixtures and their alloys.

20. A process for producing a water-containing slip as claimed in claim 1, which comprises the steps i) production of a boehmite sol in an aqueous medium, ii) addition of the remaining constituents with simultaneous homogenization to produce the slip.

21. A coated body comprising a substrate having a coating applied thereto, wherein the coating has been produced from a slip as claimed in claim 1.

22. The coated body as claimed in claim 21, wherein the substrate is selected from among metallic, ceramic or other inorganic substrates.

23. The coated body as claimed in claim 21, wherein the substrate is present in the form of a shaped part, a film, a woven fabric or a fiber.

24. The coated body as claimed in claim 21, wherein the coating has a thickness of 5-2000 μm.

25. A process for producing a coated body comprising a substrate having a coating applied thereto, which comprises the steps 1) application of the slip as claimed in claim 1 to the substrate by one or more doctor blade coating, dipping, flooding, spin coating, spraying, brushing or painting steps, 2) drying of the coating obtained in this way, 3) baking of the coating.

26. The process as claimed in claim 25, wherein the baking in step 3) is effected in situ during casting.

27. The process as claimed in claim 25, wherein the baking in step 3) is carried out at temperatures of from 180 to 800° C.

* * * * *